US006793221B2

(12) United States Patent
Giegerich et al.

(10) Patent No.: US 6,793,221 B2
(45) Date of Patent: Sep. 21, 2004

(54) KNOCKDOWN CABINET FOR DART GAME

(75) Inventors: Gary Giegerich, North Woods, PA (US); Paul Giegerich, Laverock, PA (US)

(73) Assignee: DMI Sports, Inc., Fort Washington, PA (US)

( * ) Notice: Subject to any disclaimer, the term of this patent is extended or adjusted under 35 U.S.C. 154(b) by 0 days.

(21) Appl. No.: 10/358,635

(22) Filed: Feb. 5, 2003

(65) Prior Publication Data

US 2003/0146575 A1 Aug. 7, 2003

Related U.S. Application Data

(60) Provisional application No. 60/354,375, filed on Feb. 5, 2002.

(51) Int. Cl.[7] ..... F41J 1/10; F41J 3/00; A47B 47/00

(52) U.S. Cl. ..... 273/407; 273/408; 312/251.1; 312/107

(58) Field of Search ..... 273/407, 408, 273/403, 404, 371–376; 312/257.1, 107

(56) References Cited

U.S. PATENT DOCUMENTS 3,501,149 A * 3/1970 Meyer ..... 273/407
3,866,913 A * 2/1975 Zimmers et al. ..... 473/435
4,625,974 A * 12/1986 Andrews ..... 273/407
4,807,887 A * 2/1989 DeVale et al. ..... 273/372
4,881,744 A * 11/1989 Hansen ..... 273/376
5,004,247 A * 4/1991 Menke ..... 273/376
5,085,608 A * 2/1992 Turner ..... 446/75
5,211,405 A * 5/1993 Shelton et al. ..... 273/407
6,045,132 A * 4/2000 Giegerich ..... 273/408
6,089,571 A * 7/2000 Cho ..... 273/371
6,116,607 A * 9/2000 Cho ..... 273/371
2003/0085524 A1 * 5/2003 Ross ..... 273/407

* cited by examiner

*Primary Examiner*—Mark S. Graham
(74) *Attorney, Agent, or Firm*—Akin Gump Strauss Hauer & Feld, LLP

(57) ABSTRACT

A cabinet for housing a dart game board includes an upper portion and a base portion. The upper portion is provided with a slot sized to accept a light fixture and an eyebolt for securing the cabinet to a fixed support. A face board with an opening sized and shaped to receive the dart game board may be assembled with the upper portion. The base portion is provided with a hinged door and with a supporting member extending from the base portion. The cabinet is delivered to a consumer in an unassembled state.

2 Claims, 4 Drawing Sheets

KNOCKDOWN CABINET FOR DART GAME

CROSS-REFERENCE TO RELATED APPLICATIONS

This application claims benefit of U.S. Provisional Patent Application 60/354,375, "Knockdown Cabinet for Dart Game", filed Feb. 5, 2002, the subject matter of which is incorporated herein by reference.

BACKGROUND OF THE INVENTION

The present invention relates generally to electronic dart games and, more particularly, to a knockdown cabinet for receiving and supporting an electronic dart game board.

Dart games of the electronic scoring type are generally well known in the art and are commercially available from a variety of sources. Typically, such dart games include a board having the appearance of a standard dart board, but with each of the segments or sections of the board being formed by a moveable polymeric component which moves rearwardly when struck by a dart, preferably a polymeric dart. Rearward movement of a dart board segment results in the closing of an electrical switch which is detected by electronics associated with the board and is converted to a score for the particular player. Electronic dart games of the type described have become very popular for use in sports bars and other commercial entertainment facilities. Such commercial grade electronically scored dart game boards are generally housed in large bulky heavy cabinets which are difficult to move.

More recently, smaller, more compact home versions of electronically scored dart games have been developed. Such home versions are usually not much bigger than the dart board itself with the exception of a downwardly extending scoring portion. Such home dart game boards are generally hung on a wall.

There exists a need for a cabinet adapted to receive and support the more recently developed home versions of such electronically scored dart games. The present invention comprises such a cabinet.

BRIEF SUMMARY OF THE INVENTION

According to a first aspect of the invention, a cabinet for housing a dart game board is provided. The cabinet comprises at least one structural frame forming the cabinet and a face board mountable to the cabinet. The face board has an opening sized and shaped to correspond to and mate with an outer periphery of the dart game board.

According to a second aspect of the invention, a cabinet for housing a dart game board is provided, the cabinet comprising a first structural frame forming a base portion and a second structural frame forming an upper portion. The upper portion is attachable to and supported by the base portion. A face board is mountable to the upper portion, the face board having an opening, the opening sized and shaped to correspond to and mate with an outer periphery of the dart game board. The cabinet is delivered to a consumer in an unassembled state.

According to a third aspect of the invention, a cabinet for housing a dart game board is provided, the cabinet comprising a first structural frame forming a base portion, the base portion including at least one door hingedly connected to the first structural frame. The cabinet further includes a second structural frame forming an upper portion, the upper portion being attachable to and supported by the base portion. A face board is mountable to the upper portion, the face board having an opening, the opening sized and shaped to correspond to and mate with an outer periphery of the dart game board.

According to a fourth aspect of the invention, a cabinet for housing a dart game board is provided, the cabinet comprising a first structural frame forming a base portion and a second structural frame forming an upper portion. The upper portion is attachable to and supported by the base portion. The second structural frame includes a slot sized to accept an attachment member for a lighting fixture. A face board is mountable to the upper portion, the face board having an opening, the opening sized and shaped to correspond to and mate with an outer periphery of the dart game board.

According to a fifth aspect of the invention, a cabinet for housing a dart game board is provided, the cabinet comprising a first structural frame forming a base portion and a second structural frame forming an upper portion. The upper portion is attachable to and supported by the base portion. The upper portion has a mechanical fastening element extending from an exterior surface thereof. The mechanical fastening element is configured to receive a safety line. A face board is mountable to the upper portion, the face board having an opening, the opening sized and shaped to correspond to and mate with an outer periphery of the dart game board.

According to a sixth aspect of the invention, a cabinet for housing a dart game board is provided, the cabinet comprising a first structural frame forming a base portion, the base portion being supported by a surface and including at least one stabilizing member extending from the base portion. The at least one stabilizing member contacts the surface. A second structural frame forms an upper portion. The upper portion is attachable to and supported by the base portion. A face board is mountable to the upper portion, the face board having an opening sized and shaped to correspond to and mate with an outer periphery of the dart game board.

According to a seventh aspect of the invention, a cabinet for housing a dart game board is provided, the cabinet comprising a base portion including a first top member, first and second side members, a first bottom member, a first back member and a plurality of shelves supported at least by the first and second side members. At least one front door is hingedly attached to one of the first and second side members. At least one supporting member extends from the base portion. The cabinet further comprises an upper portion including a second top member, a front awning, third and fourth side members, first and second back braces, a second bottom member, and a second back member. A slot is formed in the second top member, the slot being sized to accept an attachment member for a lighting fixture. An eyebolt is attached to an exterior of the second top member. The eyebolt is configured to receive a safety line. A face board is mountable to the upper portion, the face board having an opening positioned centrally within the face board, the opening sized and shaped to correspond to and mate with the dart game board. The cabinet is delivered to a consumer in an unassembled state.

According to an eighth aspect of the invention, a combination of a dart game board and a cabinet is provided, the cabinet comprising a first structural frame forming a base portion and a second structural frame forming an upper portion. The upper portion is attachable to and supported by the base portion. The cabinet is delivered to a consumer in an unassembled state.

According to a ninth aspect of the invention, a combination of a dart game board and a cabinet is provided, the cabinet comprising a first structural frame forming a base portion, the base portion including at least one door hingedly connected to the first structural frame, and a second structural frame forming an upper portion, the upper portion attachable to and supported by the base portion.

According to a tenth aspect of the invention, a combination of a dart game board and a cabinet is provided, the cabinet comprising a first structural frame forming a base portion, and a second structural frame forming an upper portion. The upper portion is attachable to and supported by the base portion. The second structural frame includes a slot sized to accept an attachment member for a lighting fixture.

According to an eleventh aspect of the invention, a combination of a dart game board and a cabinet is provided, the cabinet comprising a first structural frame forming a base portion, and a second structural frame forming an upper portion. The upper portion is attachable to and supported by the base portion. The upper portion has a mechanical fastening element extending from an exterior surface thereof. The mechanical fastening element is configured to receive a safety line.

According to a twelfth aspect of the invention, a combination of a dart game board and a cabinet is provided, the cabinet comprising a first structural frame forming a base portion. The base portion is supported by a surface and includes at least one stabilizing member extending from the base portion. The at least one stabilizing member contacts the surface. The cabinet further comprises a second structural frame forming an upper portion, the upper portion attachable to and supported by the base portion.

According to yet a thirteenth aspect of the invention, a combination of a dart game board and a cabinet is provided, the cabinet comprising a base portion including a first top member, first and second side members, a first bottom member, a first back member and a plurality of shelves supported at least by the first and second side members. At least one front door is hingedly attached to one of the first and second side members. At least one supporting member extends from the base portion. The cabinet further comprises an upper portion including a second top member, a front awning, third and fourth side members, first and second back braces, a second bottom member, and a second back member. A slot is formed in the second top member, the slot being sized to accept an attachment member for a lighting fixture. An eyebolt is attached to an exterior of the second top member. The eyebolt is configured to receive a safety line. The cabinet is delivered to a consumer in an unassembled state.

BRIEF DESCRIPTION OF THE SEVERAL VIEWS OF THE DRAWINGS

The following detailed description of preferred embodiments of the invention will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
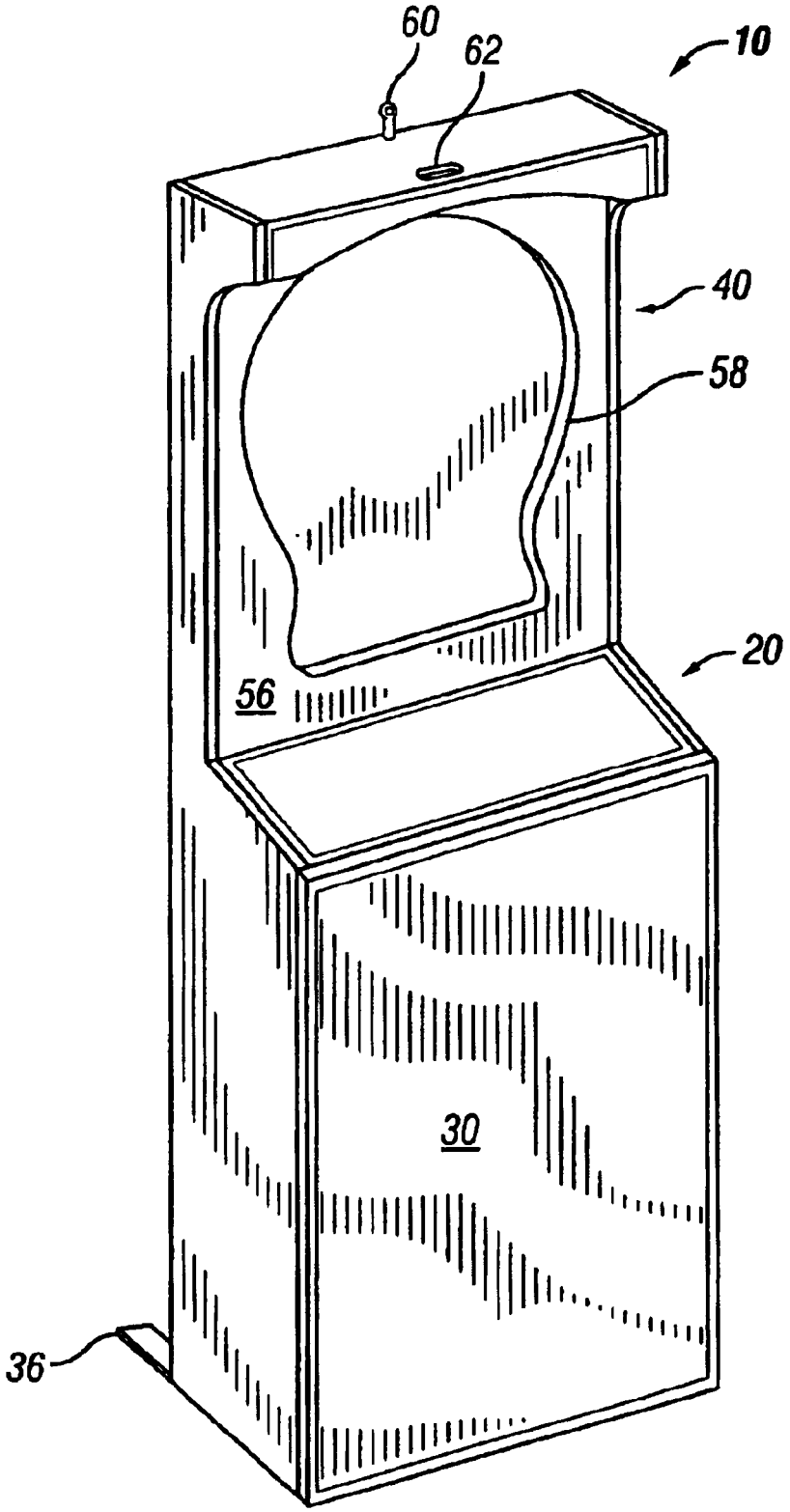
FIG. 1 is a front perspective view of a knockdown cabinet for supporting an electronically scored dart game board in accordance with a preferred embodiment of the present invention.
Figure 4:
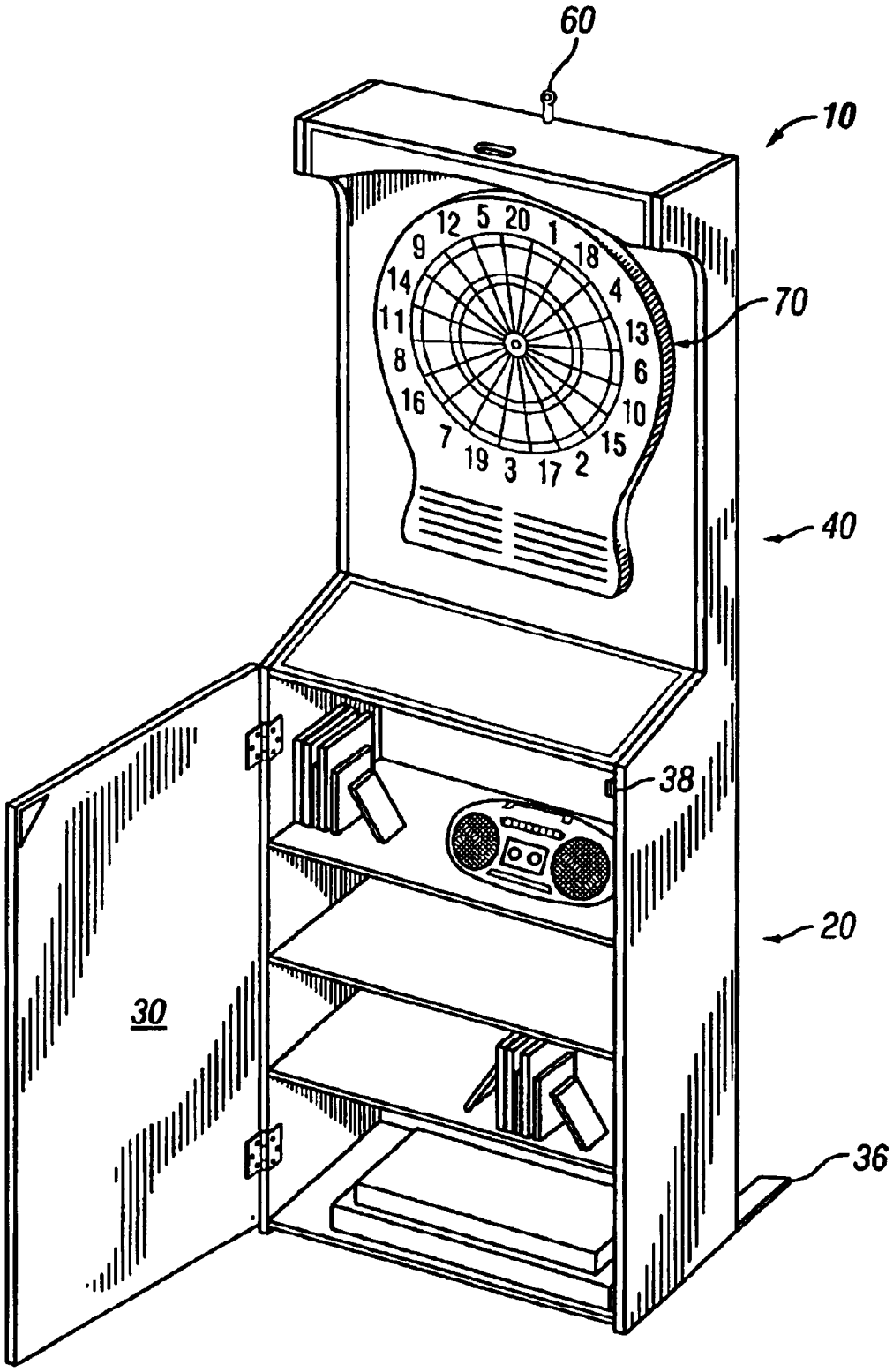
FIG. 4 is a front perspective view of the cabinet of FIG. 1, shown with the dart game board installed and a door of the base portion ajar to show an interior storage space.

Referring to the drawings, wherein like referenced numerals are used to designate the same components throughout the several figures, there is shown in FIG. 1 a cabinet 10 in accordance with the present invention which is employed for supporting an electronically stored dart game board 70, as shown in FIG. 4. The electronically scored dart game board 70 is of a type well known to those of ordinary skill in the art and available from a variety of sources, particularly under the "Arachnid" brand. Further details of the structure and operation of the electronically scored dart game board 70 are not necessary for a complete understanding of the present invention and, therefore, will not be presented.

Figure 2:
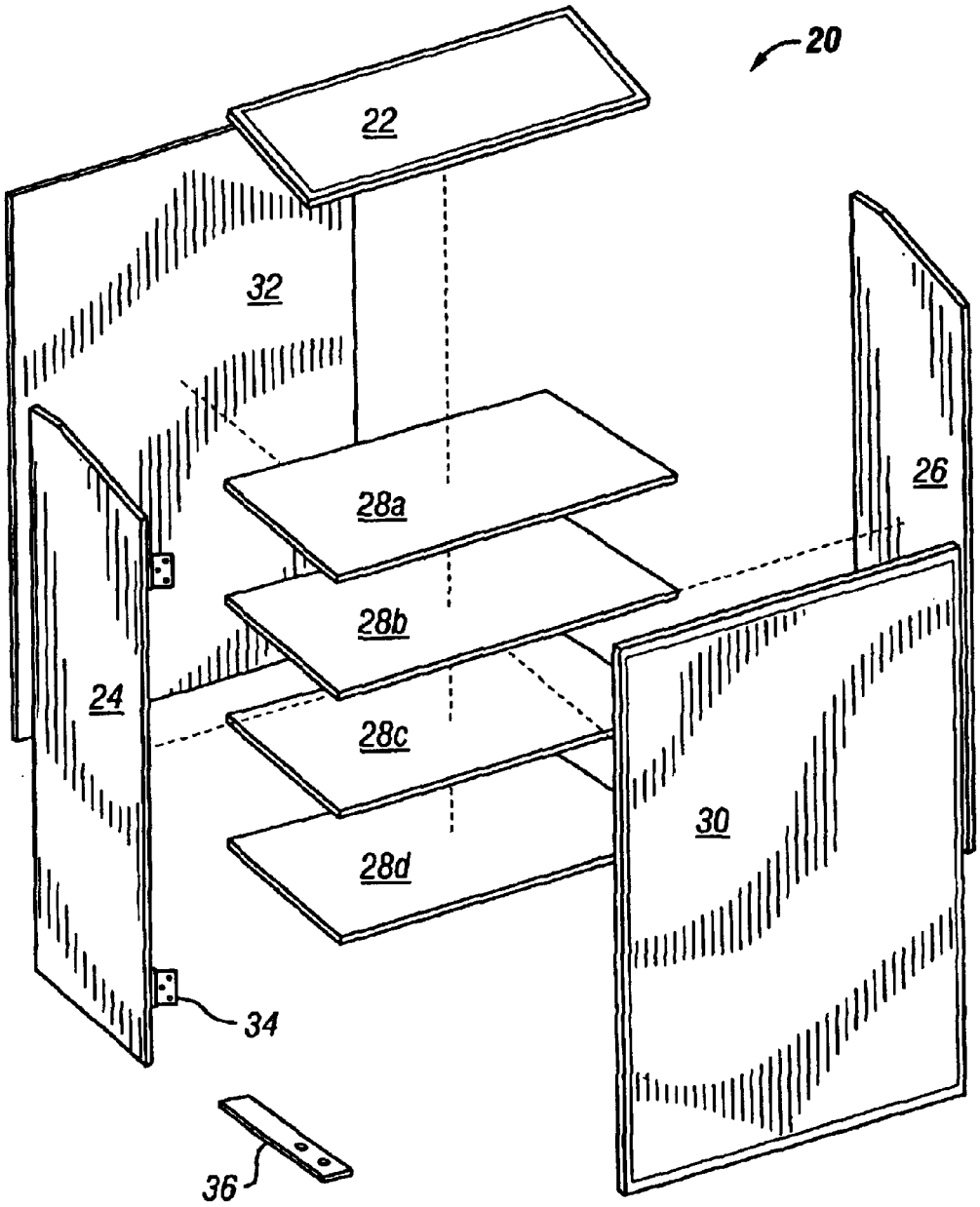
FIG. 2 is an exploded view of a base portion of the cabinet of FIG. 1.
Figure 3:
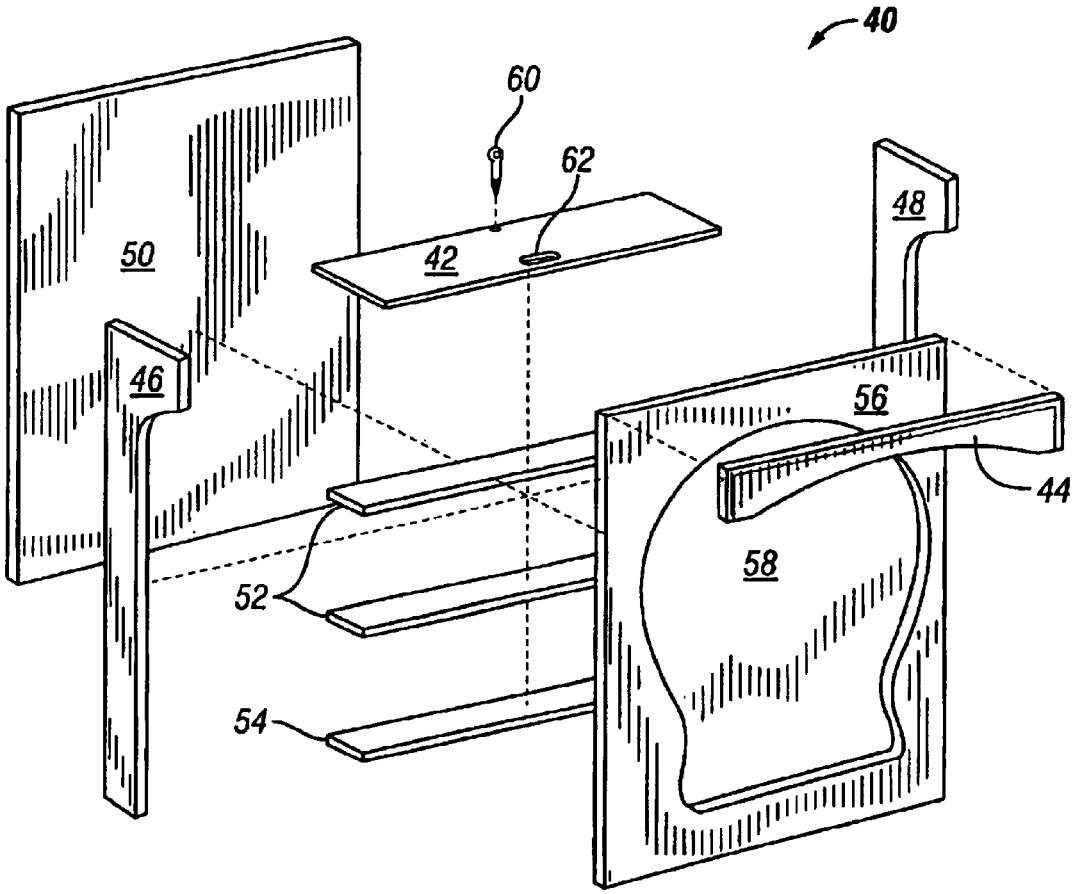
FIG. 3 is an exploded view of an upper portion of the cabinet of FIG. 1.

A principle feature of the cabinet 10 is the fact that when the cabinet 10 is shipped to a customer, it is in a knockdown, or unassembled, state. The cabinet 10 may thus be conveniently shipped in a much smaller carton or cartons than would be required if the cabinet 10 were shipped fully assembled. The cabinet 10 is designed to be quickly and conveniently assembled by a purchaser. FIG. 2 is an exploded view of a base portion 20 of the cabinet 10, illustrating the base portion 20 in an unassembled condition. Similarly, FIG. 3 is an exploded view of an upper portion 40 of the cabinet 10, showing the upper portion 40 in an unassembled state. For the purposes of this disclosure, the cabinet 10 being "unassembled" means that the cabinet 10 has not been assembled into the cabinet's final configuration. That is, the cabinet 10 is "unassembled" if all of the individual elements were separated as illustrated in FIGS. 2 and 3. The cabinet 10 is also "unassembled" if the base portion 20 was not assembled with the upper portion.

As seen particularly in FIGS. 2 and 4, the base portion 20 comprises a first structural frame assembly formed by a first top member 22, first and second side members 24 and 26, a plurality of shelves 28*a*–28*d*, a door 30 hingedly connected to first side member 24 by a pair of hinges 34, a first back member 32 and a pair of stabilizing feet 36. The lowermost shelf 28*d* also forms a first bottom 28*d*.

The stabilizing feet 36 are secured to the first bottom 28*d* of the base portion 20 so that each foot 36 extends outwardly as shown in FIG. 4 for a preferred embodiment. In this manner the feet 36 (one on each side in the preferred embodiment illustrated) provide additional stability for helping to support the cabinet 10, particularly if the cabinet 10 is not placed near a wall. The artisan would recognize that the stabilizing feet 36 could be oriented in many different configurations, for example extending forward of the cabinet 10.

A prominent feature of the base portion 20 of the cabinet 10 is the storage which is afforded therein. The shelves 28*a*–28*d* are provided within the interior of the base portion 20 of the cabinet 10. The door 30 provides access to the shelving 28*a*–28*d* within the interior of the base cabinet 20 as shown in FIG. 4. If desired, the door 30 could be separated into two separate doors, each about ½ of the width of door 30. A magnetic catch 38 of the type known to those of ordinary skill in the art may be used for holding the door 30 in a closed position.

As seen particularly in FIG. 3, the upper portion 40 comprises a second structural frame assembly formed by a second top member 42, a front awning 44, third and fourth side members 46 and 48, a second back member 50, a plurality of brace members 52 and a second bottom 54. A face board member 56 is provided with a central opening 58. The opening 58 is sized and shaped to correspond to and mate with the dart game board 70. The dart game board 70 may be installed and retained within the opening 58 as shown in FIG. 4. If desired, additional fasteners (not shown) may also be employed for holding the dart game board 70 in place within the opening 58.

The upper portion is further provided with a mechanical fastening element 60, preferably an eyebolt. When the cabinet 10 is fully assembled and installed, a safety line or wire (not shown) may be employed for securing the upper portion 40 of the cabinet 10 to a wall (not shown) or other fixed support using the fastening element 60 to help prevent the cabinet 10 from tipping forward.

The upper portion is further provided with a slot 62 formed in the second top member 42 and extending completely therethrough. In the present embodiment, the opening is generally oval in shape but, could be any other suitable shape, if desired. The slot 62 is adapted to receive an attachment member (not shown) such as a bolt or other mechanical fastener associated with a light (not shown) which is employed for shining onto the dart game board 70 to provide additional light, particularly in the area of the dart board.

Preferably the major structural components of both the base portion 20 and the upper portion 40 of the cabinet 10 are made of a lightweight, generally rigid material such as a polymeric material, plywood, particle board, or a similar wood-based product and are precut and presized as shown in FIGS. 2 and 3 to facilitate quick and easy assembly by the consumer.

Detailed assembly instructions are provided by the manufacturer. Briefly, the consumer assembles the upper portion 40 using the pre-cut and pre-sized components described above herein. Assembly of the upper portion 40 includes steps wherein the dart game board 70 is installed into the opening 58 of the face board, and the face board assembled into the remainder of the upper portion 40. The base portion 20 is similarly assembled. The upper portion 40 is then secured to and assembled with the base portion 20 to form the cabinet assembly 10. If desired, the cabinet 10 may be secured to a fixed support using the mechanical fastening element 60, as described above herein.

From the foregoing it can be seen that the present invention comprises a knockdown cabinet for receiving and supporting an electronically scored dart game board particularly of the type for non-commercial or home use. The cabinet, as disclosed, in addition to its knockdown feature, includes a hinged door to provide storage within the cabinet base, rearwardly extending feet on each side to provide enhanced stability, an eyebolt for providing enhanced stability, a slot for securing a light thereto and an opening which is sized and shaped for receiving an electronically scored dart game board therein. It will be appreciated by those of ordinary skill in the art that modifications may be made to the above described embodiment without departing from the scope and spirit of the present invention.

We claim:

1. A cabinet for housing a dart game board comprising:

a base portion including a first top member, first and second side members, a first bottom member, a first back member and a plurality of shelves supported at least by the first and second side members, at least one front door hingedly attached to one of the first and second side members, and at least one supporting member extending from the base portion, an upper portion including a second top member, a front awning, third and fourth side members, first and second back braces, a second bottom member and a second back member;

a slot formed in the second top member, the slot sized to accept an attachment member for a lighting fixture;

an eyebolt attached to an exterior of the second top member, the eyebolt configured to receive a safety line;

a face board mountable to the upper portion, the face board having an opening positioned centrally within the face board, the opening sized and shaped to correspond to and mate with the dart game board, wherein the cabinet is delivered to a consumer in an unassembled state.

2. A combination of a dart game board and a cabinet, the cabinet comprising:

a base portion including a first top member, first and second side members, a first bottom member, a first back member and a plurality of shelves supported at least by the first and second side members, at least one front door hingedly attached to one of the first and second side members, and at least one supporting member extending from the base portion, an upper portion including a second top member, a front awning, third and fourth side members, first and second back braces, a second bottom member and a second back member;

a slot formed in the second top member, the slot sized to accept an attachment member for a lighting fixture;

an eyebolt attached to an exterior of the second top member, the eyebolt configured to receive a safety line, wherein the cabinet is delivered to a consumer in an unassembled state.

* * * * *